United States Patent [19]

Rasmussen

[11] Patent Number: 4,864,756

[45] Date of Patent: Sep. 12, 1989

[54] ILLUMINATED SIGN BOX

[75] Inventor: Poul Rasmussen, Varde, Denmark

[73] Assignee: Colorlux A/S, Esbjerg N. ., Denmark

[21] Appl. No.: 135,341

[22] Filed: Dec. 21, 1987

[30] Foreign Application Priority Data

Jan. 9, 1987 [DK] Denmark ..... 0114/87

[51] Int. Cl.[4] ..... G09F 17/00

[52] U.S. Cl. ..... 40/603

[58] Field of Search ..... 40/603, 604; 160/391, 160/378, 387; 38/102.4, 102.5, 102.91

[56] References Cited

U.S. PATENT DOCUMENTS

| | | | |
|---|---|---|---|
| 320,290 | 6/1885 | Rosch | 160/387 |
| 760,367 | 5/1904 | Ambrose | 160/387 |
| 2,269,718 | 1/1942 | Huber | 40/564 |
| 4,041,861 | 8/1977 | Alter | 40/603 |
| 4,265,039 | 5/1981 | Brooks | 40/603 |
| 4,317,302 | 3/1982 | Von de Linde | 40/603 |
| 4,372,071 | 2/1983 | Vicino | 40/603 |
| 4,441,269 | 4/1984 | Dahl | 40/603 |
| 4,452,000 | 6/1984 | Gandy | 40/603 |
| 4,542,605 | 9/1985 | Gandy | 40/603 |
| 4,554,754 | 11/1985 | Stilling | 40/603 |
| 4,674,213 | 6/1987 | Keithley | 40/603 |
| 4,674,214 | 6/1987 | Gandy | 40/603 |

*Primary Examiner*—Robert P. Swiatek
*Assistant Examiner*—Cary E. Stone
*Attorney, Agent, or Firm*—Abelman, Frayne, Rezac & Schwab

[57] ABSTRACT

A sign box has a translucent front panel of flexible material which is attached to the longitudinal edges of a reflector of channel-shape, and which is stretched and tensioned by forcing the longitudinal edges of the reflector away from each other by means of reaction members contained within the reflector.

6 Claims, 4 Drawing Sheets

ILLUMINATED SIGN BOX

FIELD OF THE INVENTION

The invention relates to an illuminated sign box comprising a reflector of thin plate and one or more light sources mounted thereon, such as fluorescent tubes, whereby the transparent portion of the illuminated sign box is formed by a resilient cloth.

SUMMARY OF THE INVENTION

The present invention illustrates how the resilient cloth can be tightened up, and the illuminated sign box according to the invention is characterized by stretching the resilient cloth between the edges of the reflector, said cloth being bent about one or more rods. The cloth may furthermore be stretched about rods in outer corners of the illuminated sign box.

In order to hide the rods in the inner corners the rods in the inner corners of the illuminated sign box may be surrounded by an elongated, hollow body having a longitudinal slot for the placing of the cloth about a rod.

The edge of the cloth may for instance be introduced in a longitudinal slot of an Al-rod which is subsequently turned so as to fasten said cloth.

The tightening up may alternatively be carried out by a screw being screwed into a tightening-up device.

BRIEF DESCRIPTION OF THE DRAWINGS

The invention will be described below with reference to the accompanying drawings, in which.

DESCRIPTION OF THE PREFERRED EMBODIMENTS

Figure 3:
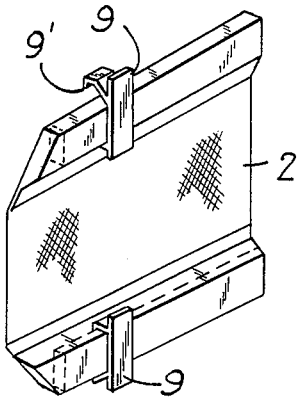
FIG. 3 illustrates the transparent cloth with clips to be secured to mouldings along the edge of the reflector.
Figure 4:
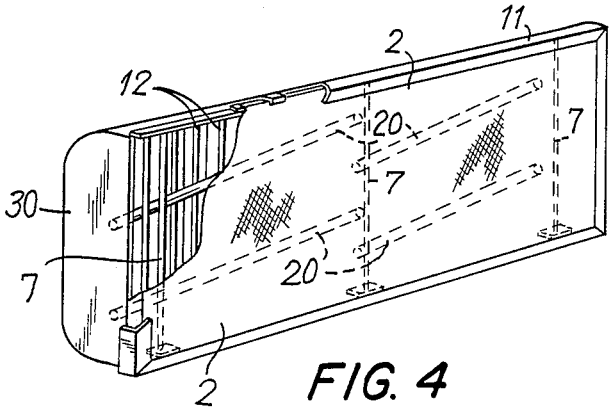
FIG. 4 illustrates the completed illuminated sign box.
Figure 6:
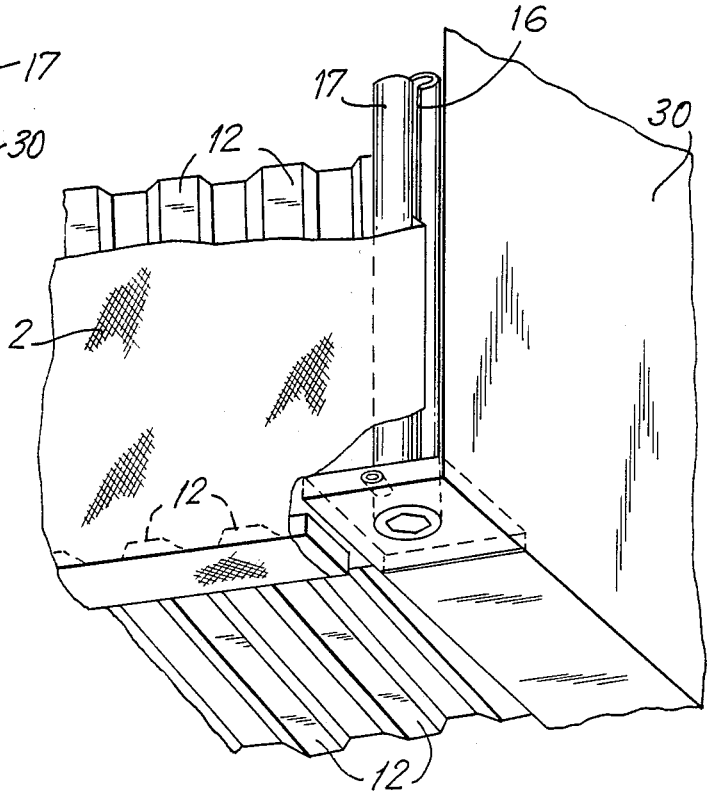
FIG. 6 illustrates the tightening up at the end of the illuminated sign box.

The illuminated sign box according to the invention comprises a reflector 1 of thin plate and one or more light sources 20 mounted thereon, such as fluorescent tubes. The transparent front plate is according to the invention replaced by a transparent resilient cloth 2 stretched between the edges of the reflector 1. The reflector 1 is a thin, curved plate provided prior to the curving with a pattern of projections in the form of parallel embossings 12 of a substantially trapezoidal cross section as more clearly illustrated in FIG. 6. In this manner the reflector is rather rigid partly on account of the strain-hardening during the pressing procedure and partly on account of the resistance moments of the embossings on the reflector plate. By making the embossings symmetrical, i.e. by shaping them as isosceles trapezia, a symmetrical distribution of light is furthermore obtained on the front transparent portion. A distribution of light being completely uniform in practice is furthermore obtained provided the embossings are sufficiently tightly arranged. A plurality of tightening-up devices 3 are mounted adjacent the edges of the reflector 1. Each tightening-up device 3 is formed by a bushing 4 secured by welding to a plate 5. This plate 5 is provided with a screw thread for a tightening screw 6. A reinforcing rod 7, cf. FIG. 1, is mounted between the tightening-up devices 3, 3', said reinforcing rod 7 being introduced in the bushings 4. The edge of the cloth 2 is bent and sewn, cf. FIG. 3. An aluminium rod 8 of a rectangular cross section is situated inside the bending. Clips 9 are mounted on the aluminium rod and can engage behind the edge of mouldings 10 along the edge of the reflector 1. When the screw 6 in the tightening-up device 3 is screwed out the rear box is so resilient that the clips.9 mounted on the cloth 2 can be mounted on the mouldings 10 along the edge of the reflector. The tightening up is subsequently carried out by the screw 6 being screwed into the tightening-up device 3. A covering moulding 11 may subsequently be engaged by the clips 9.

Figure 1A:
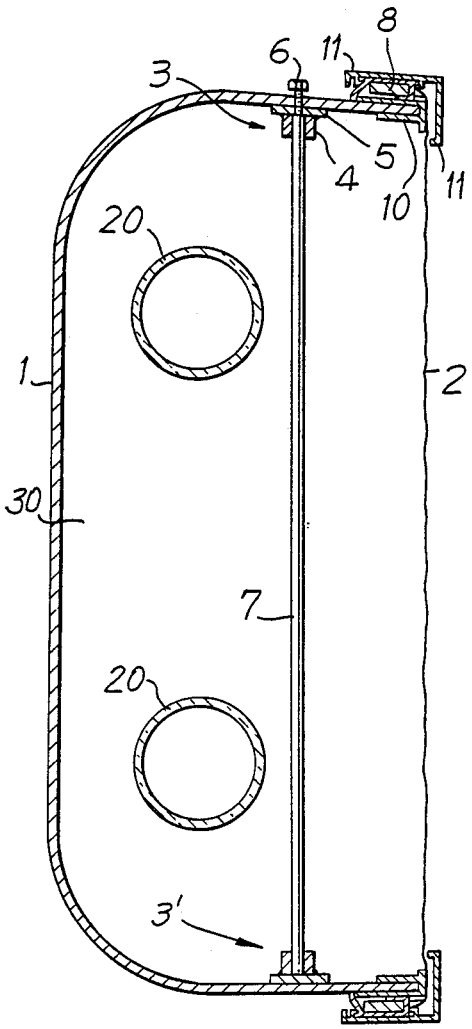
FIG. 1*a* illustrates the illuminated sign box having a loosely hanging transparent cloth.
Figure 1B:
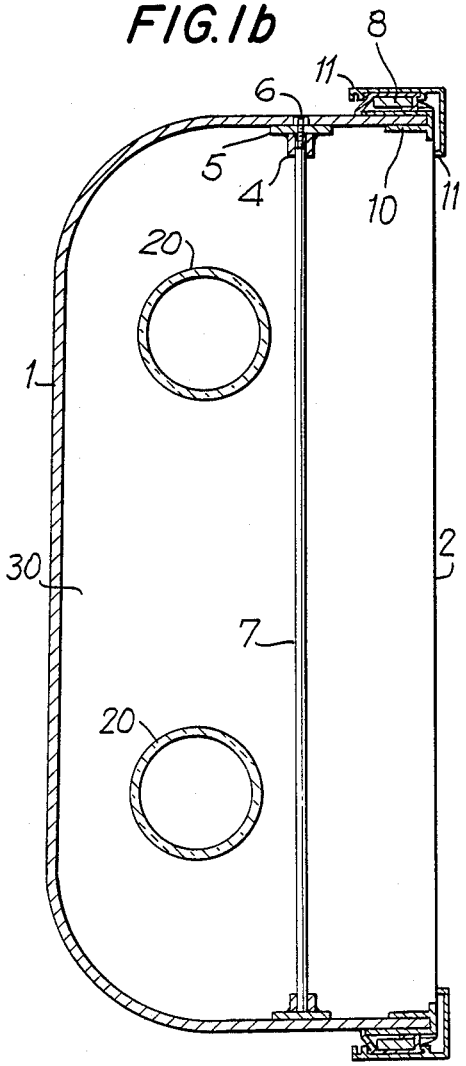
FIG. 1*b* illustrates the illuminated sign box in a situation where the transparent cloth is stretched.
Figure 2:
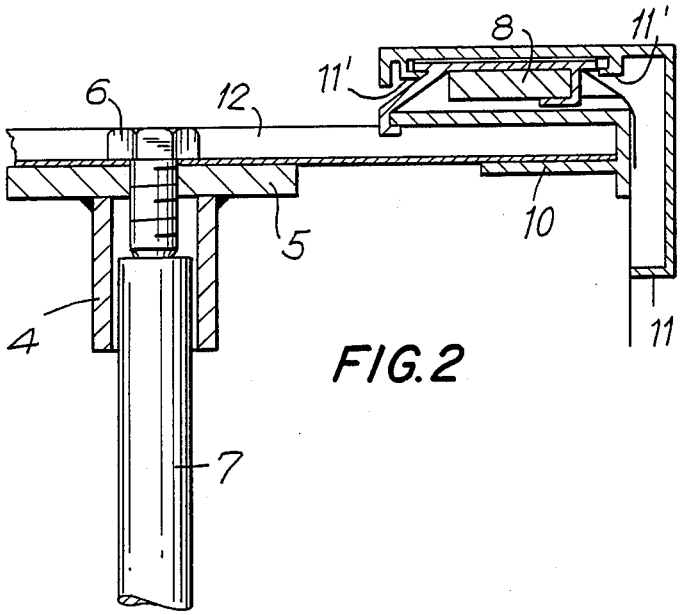
FIG. 2 illustrates on a larger scale the tightening-up device.

FIG. 1*a* is a sectional view through an illuminated sign box comprising tightening-up devices 3, 3' and a reinforcing rod 7. The transparent cloth 2 is loosely mounted on the reflector at which time, and the screw 6 in the tightening-up device 3 is slackened. FIG. 1*b* illustrates the illuminated sign box after the screw 6 has been screwed into the tightening-up device 3 whereby the reflector expands and stretches the cloth 2. The tightening-up device 3 comprises a bush member. The bush member comprises a bushing 4 secured by welding to a sheet material provided with a screw thread. The lower bush member 3' comprises merely a bushing secured by welding to a sheet material in turn secured to the reflector.

The clip is provided with a bent portion 9' capable of engaging behind the edge of the moulding 10. The clip 9 is furthermore provided with projections for the mounting of the covering moulding 11 in turn provided with corresponding hooks 11'.

The end cover 30 of the illuminated sign box is of a conventional type.

The cloth may for instance be made of nylon-containing PVC whereas the remaining members are preferably made of aluminium.

The invention thus provides an illuminated sign box which is more resilient than the previously known boxes, and which is more resistant to impacts and the like actions.

Figure 5:
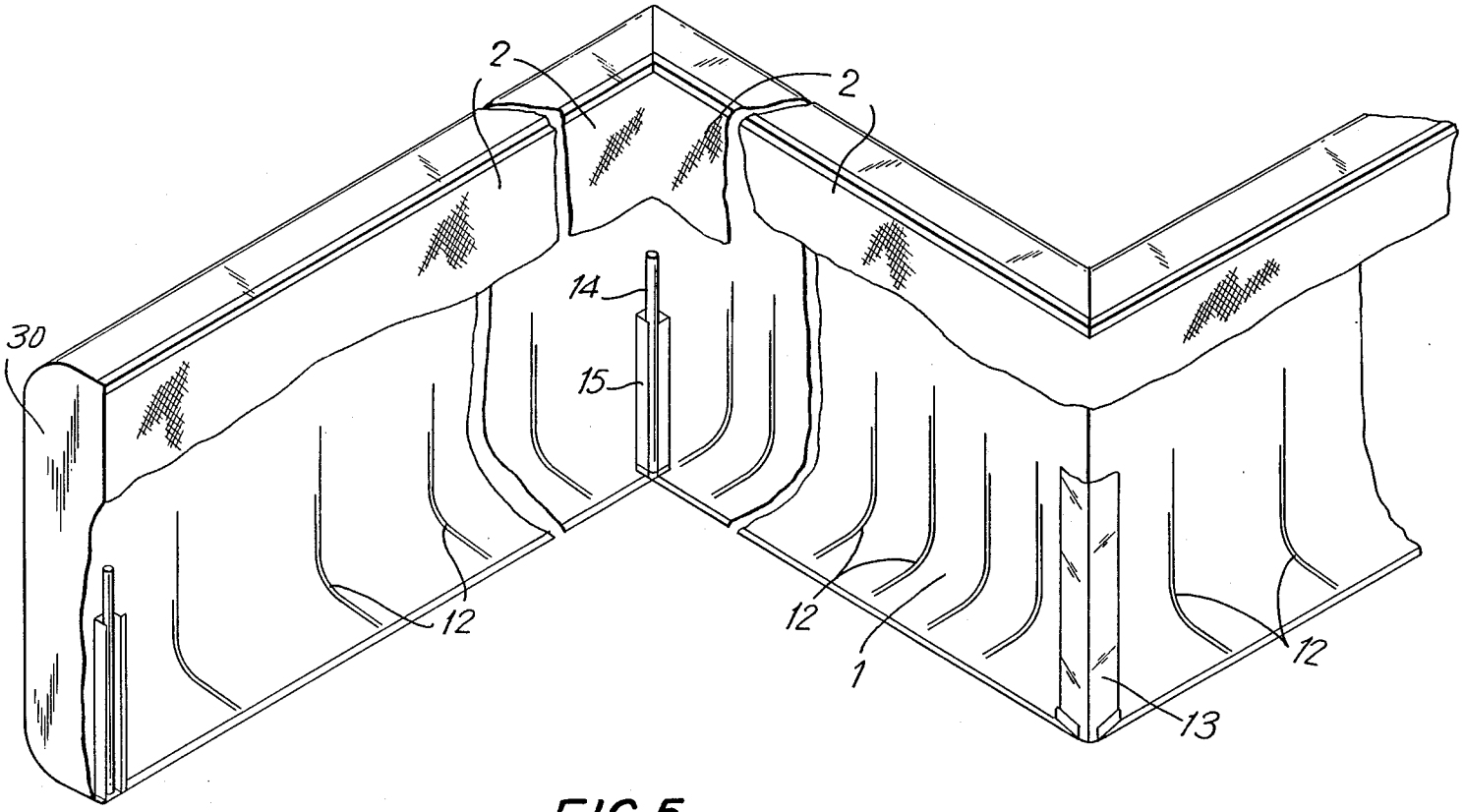
FIG. 5 illustrates an illuminated sign box with inner and outer corners.
Figure 5A:
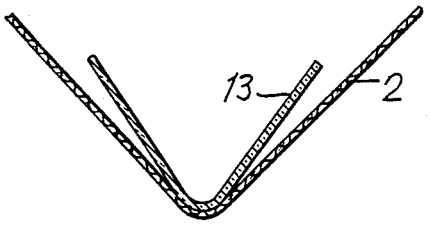
FIGS. 5*a*, 5*b* and 5*c* illustrate details of FIG. 5
Figure 5B:
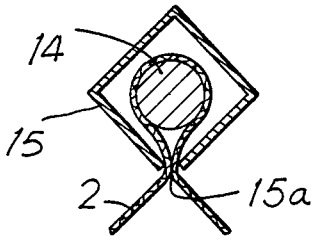
Figure 5C:
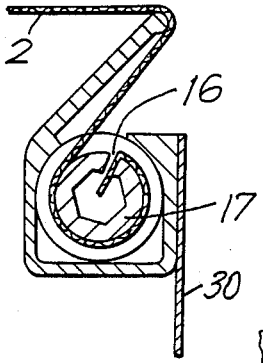

According to an alternative embodiment the illuminated sign box is provided with outer and inner corners, cf. FIG. 5, where the cloth is stretched between rods 13, 14 in the corners as shown in FIG. 5*a*. In order to hide the rods 14 in the inner corners these rods can be surrounded by an elongated, hollow body 15 as shown in FIG. 5*b* having a longitudinal slot for the placing of the cloth about the rod. The edge of the cloth is inserted in a longitudinal slot 16 of an aluminum rod 17 situated at the end of the illuminated sign box. This Al-rod can be turned by means of a key so as to secure the cloth, cf. FIGS. 5*c* and 6.

A particular advantage of the illuminated sign box according to the invention is that the transparent cloth can be poststretched, if desired.

The illuminated sign box according to the invention is more resistant to impacts and the like actions than the previously known sign boxes.

I claim:

1. An illuminated sign box comprised of:

a reflector containing a light source and which is formed from a substantially rigid material, said reflector providing a rear wall and forwardly extending top and bottom walls formed integrally with said rear wall;

means for attaching opposite edges of a flexible sheet of translucent material to said top and bottom walls with said sheet extending between said top and bottom walls; and, reaction means provided internally of said reflector and adjacent the free edges of said top and bottom walls for forcing said respective top and bottom walls in opposite directions and away from each other;

whereby to stretch and tension said flexible sheet between said top and bottom walls.

2. The illuminated sign box according to claim 1, in which said reflector is formed with corrugations extending transversely of the longitudinal axis of said reflector, and which extend continuously through said bottom wall, rear wall, and top wall to enhance the stiffness of said reflector.

3. The illuminated sign box of claim 1, in which said reaction means comprise a socket member secured on an inner surface of said bottom wall, a socket member secured on an inner surface of said top wall and aligned with the socket member on said bottom wall, a rod having its respective ends inserted into said respective socket members, and an adjustable means associated with one of said socket members for placing said rod under compression, in turn forcing said top and bottom walls in said opposite direction and away from each other.

4. The illuminated sign box of claim 1, in which said attaching means includes a molding secured to a said free edge of one of said top and bottom walls, a flat bar received within a pocket formed at a said opposite edge of said flexible sheet, and clips engaged over said flat bar and engaged with an edge of said molding.

5. The illuminated sign box according to claim 1, including a roller tensioner at one vertical edge of said flexible sheet for tensioning said sheet in a direction transverse to said opposite edges of said flexible sheet.

6. The illuminated sign box of claim 1, including members providing a transition between two said sign boxes arranged and secured at an angle to each other at adjacent axial ends thereof, said transition members including a post attached between said top and bottom walls at said adjacent axial ends, and a tubular sleeve positioned over said post and having an axial slot extending throughout its length, said flexible sheet extending around said post and through said slot.

* * * * *